US005656415A

United States Patent [19]

Roussilhe et al.

[11] Patent Number: 5,656,415

[45] Date of Patent: Aug. 12, 1997

[54] COMPOSITION FOR DEVELOPING AN EXPOSED PHOTOGRAPHIC PRODUCT HAVING IMPROVED STABILITY IN AIR

[75] Inventors: Jacques Roussilhe, Virey Le Grand; Claude Germain Goumont, Mellecey, both of France

[73] Assignee: Eastman Kodak Company, Rochester, N.Y.

[21] Appl. No.: 609,803

[22] Filed: Mar. 1, 1996

[30] Foreign Application Priority Data

Mar. 2, 1995 [FR] France ..... 95 02668

[51] Int. Cl.[6] ..... G03C 5/58

[52] U.S. Cl. ..... 430/413; 430/416; 430/464; 430/477; 430/479

[58] Field of Search ..... 430/464, 477, 430/479, 413, 416

[56] References Cited

U.S. PATENT DOCUMENTS

| | | | |
|---|---|---|---|
| 3,567,441 | 3/1971 | Vogt | 430/379 |
| 3,645,736 | 2/1972 | Mowat | 430/477 |
| 3,723,126 | 3/1973 | Price | 430/456 |
| 3,887,375 | 6/1975 | Newman et al. | 430/479 |
| 3,964,912 | 6/1976 | Price | 430/435 |
| 3,982,945 | 9/1976 | Willems | 430/436 |
| 4,702,998 | 10/1987 | Tanaka et al. | 430/430 |
| 4,837,122 | 6/1989 | Kondo et al. | 430/331 |
| 5,149,618 | 9/1992 | Tappe et al. | 430/430 |
| 5,217,855 | 6/1993 | Okada et al. | 430/430 |
| 5,238,791 | 8/1993 | Tappe et al. | 430/393 |
| 5,310,631 | 5/1994 | Nakamura et al. | 430/447 |
| 5,434,035 | 7/1995 | Craver et al. | 430/430 |
| 5,447,821 | 9/1995 | Okada et al. | 430/430 |
| 5,508,150 | 4/1996 | Craver et al. | 430/430 |

FOREIGN PATENT DOCUMENTS

| | | | |
|---|---|---|---|
| 3939756 | 12/1989 | Germany | G03C 7/42 |
| 55-146448 | 11/1980 | Japan | G03C 5/26 |
| 1-319034 | 6/1988 | Japan | G03C 50/30 |
| 4073647 | 3/1992 | Japan | 430/477 |
| 5019430 | 1/1993 | Japan | 430/430 |
| 1330602 | 8/1987 | U.S.S.R. | 430/477 |
| 720235 | 12/1954 | United Kingdom . | |

OTHER PUBLICATIONS

Research Disclosure 12142 (May 1974).
Research Disclosure 12440 (Aug. 1974).

*Primary Examiner*—Hoa Van Le
*Attorney, Agent, or Firm*—J. Lanny Tucker

[57] ABSTRACT

A novel inorganic composition for developing silver halide photographic products has improved stability in air. The composition comprises at least one oxidizable metallic ion, ethylenediamine tetraacetic acid and at least one additional complexing agent of formula (I):

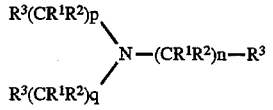

wherein $R^1$ and $R^2$ are each independently a hydrogen atom, an alkyl group of 1 to 10 carbon atoms, a hydroxyl group, or a hydroxyalkyl group, $R^3$ is —COOM wherein M is hydrogen or a counter-ion such as lithium, sodium or potassium, or —$CONR^4R^5$ wherein $R^4$ and $R^5$ are each independently a hydrogen atom, an alkyl group of 1 to 10 carbon atoms, and n, p and q are independently 1, 2 or 3.

11 Claims, No Drawings

COMPOSITION FOR DEVELOPING AN EXPOSED PHOTOGRAPHIC PRODUCT HAVING IMPROVED STABILITY IN AIR

FIELD OF THE INVENTION

The present invention relates to a novel composition for developing silver halide photographic products having improved biodegradability and resistance to oxidation in air. In particular, the invention relates to a rapid-access developing solution that contains an organometallic complex as the developing agent and to a method for its use.

BACKGROUND OF THE INVENTION

In conventional processing methods, photographic products comprising silver halide grains carrying a latent image formed by exposure to radiation are developed by immersing the photographic product in an alkaline solution containing a reducing developing agent. The developing agent is generally an organic compound selected from the di- and polyhydroxybenzenes, aminophenols and reductones. The dihydroxybenzenes that are used most often are for example hydroquinone and its derivatives, and catechol and its derivatives. Examples of aminophenols include 4-amino-1-hydroxybenzene and its derivatives. The most important reductones include ascorbic acid, D-isoascorbic acid and their derivatives and salts. These organic developers can be used along with an auxiliary developing agent such as phenidones or Elon®.

It is also known that inorganic developing compositions can be used which contain, as a developing agent, metallic ions that are capable of changing valency in order to be able to reduce the silver ions to metallic silver.

The activity of these inorganic developers can be improved by the presence of a complexing agent able to form an organometallic complex with the metallic ion of higher valency. By thus eliminating the oxidized form of the metallic ion as it is formed, the thermodynamic force of the reduction reaction of the silver and the corresponding oxidation of the metallic ions is maintained. According to T. H. James, *Photo. Sci.&Eng.,* 4(5) 271–280, (1960) these organometallic complexes can be used to develop different types of silver halides within a wide pH range. The mechanism of such a development was described by H. J. Price in the *J. Photo. Sci.Eng.,* 14(6), 391–396, (1970) and 19(5), 283–287, (1975).

French Patent 1,068,805 describes the use of complexes of iron (II) and titanium (III) with particular aliphatic aminopolycarboxylic acids, and the salts of these acids, in order to develop silver halide photographic products, after exposure. The described aminopolycarboxylic acids are characterized in that the amino group or groups comprise at most one hydrogen atom bonded directly to the nitrogen atom. The aminopolycarboxylic acids cited are ethylenediamine tetraacetic acid (EDTA), methylenediamine tetraacetic acid (MDTA), nitrilotriacetic acid (NTA) and diethylenetriamino diacetic acid.

U.S. Pat. No. 3,887,375 describes an inorganic developer consisting of chelated ferrous ions and ascorbic acid. According to this patent, the ascorbic acid provides air stability of a developing composition containing an inorganic developer.

If the conventional organic developers, for example developers containing hydroquinone derivatives, are compared with so-called "inorganic" developers comprising organometallic complexes, it appears that organic developers may have certain advantages. They may, for example, be more readily soluble in water. They can also be used within a wider pH range, which makes it possible to use less alkaline processing baths. In addition, the organometallic complexes form reversible redox systems, which makes it possible to easily determine and control the redox potential of the developing bath and to regenerate the oxidized form of the metallic complex into its initial reducing form simply by reduction of the processing bath.

The possibility of regenerating this type of developing bath makes it possible to obtain ecological processing by minimizing the volume of effluents.

As is described by the art, metallic developers are always associated with an organic complexing agent in order to form an organometallic complex. This complexing agent is generally EDTA, which is particularly effective but has low biodegradability.

Furthermore, these inorganic developers exhibit low stability in air, linked to the oxidation of the developing composition. G. M. Haist et al, in *Photographic Engineering,* 7(3), 182 (1956), indicate that the practical application of these inorganic developers is limited because it requires oxygen-free atmospheres. In U.S. Pat. Nos. 2,453,323 and 3,567,441, it is asserted that the development must be carried out in a non-oxidizing atmosphere, for example under nitrogen.

It would be desirable to have an inorganic developer composition that is more ecological and has better resistance to oxidation in air.

SUMMARY OF THE INVENTION

The problems noted above are overcome with an inorganic photographic developing composition comprising at least one oxidizable metallic ion, ethylenediamine tetraacetic acid (EDTA) and at least one additional complexing agent of formula (I):

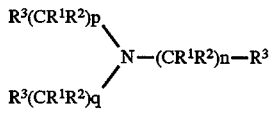

wherein $R^1$ and $R^2$ are each independently a hydrogen atom, an alkyl group of 1 to 10 carbon atoms, a hydroxyl group, or a hydroxyalkyl group, $R^3$ is —COOM wherein M is hydrogen or a counter-ion or —$CONR^4R^5$ wherein $R^4$ and $R^5$ are each independently a hydrogen atom, an alkyl group of 1 to 10 carbon atoms, and n, p and q are 1, 2 or 3.

This invention also comprises a method for processing an imagewise exposed photographic product comprising developing the product with the composition described above.

According to the present invention, a part of the EDTA useful for complexing the oxidizable metallic ions has been replaced by a significant quantity of at least one aminopolycarboxylic acid complexing agent that is more biodegradable than EDTA, which presents no problem as regards the environment and safety, and which is not toxic.

Within the scope of the present invention, ecological developing compositions are obtained which, moreover, have an improved resistance to oxygen in the air, linked to the formation in the developing composition of metallic complexes formed from oxidizable metallic ions, EDTA and an additional complexing agent or agents.

DETAILED DESCRIPTION OF THE INVENTION

Within the scope of the present invention, the complexing agent of formula (I) is such that at least one, and preferably two, of the $R^3$ groups are —COOM groups, M being as defined below.

According to the present invention, the alkyl groups include straight or branched chain, substituted or not. The counter ions can be for example lithium, sodium or potassium ions.

According to the invention, the complexing agent of formula (I) can for example be β-alanine diacetic acid (ADA), nitrilotriacetic acid (NTA), (acetamido) iminodiacetic acid (AIDA), N,N-dicarboxyethylglycine acid (GDPA), or(dimethylacetamido)iminodiacetic acid (DMAIDA).

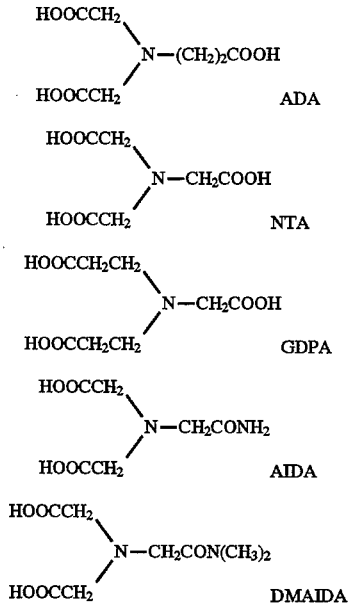

In the inorganic developing composition of this invention, the concentration of oxidizable metallic ions is preferably between 0.05M and the solubility limit of the metallic ions in the developing composition (at the temperature of use of the composition). This concentration is preferably between 0.1 and 0.5M.

The total concentration of complexing agents must be at least equimolar with that of the oxidizable metallic ions. However, the use of developing compositions in which the concentration of complexing agents is greater than the concentration of metallic ions is preferred.

In the present invention, the total molar concentration of complexing agents [EDTA+additional complexing agents (I)] is such that the metallic ion/complexing agent molar ratio is between 1/1 and 1/10, preferably ½ and ¼. According to one embodiment, the complexing agent of formula (I) represents at least 10% of the total molar concentration of complexing agents, preferably between 10 and 90%.

For ecological reasons, it is advantageous to use a molar concentration of additional complexing agents of formula (I) greater than or equal to the concentration of EDTA, that is to say a concentration of additional complexing agents of formula (I) which represents at least 50% of the total concentration of complexing agents.

Oxidizable metallic ions that are useful as developing agents are, for example, titanium, iron, vanadium or chromium ions. They are generally used in the form of salts.

For the present invention, the activity of the developing composition can be maintained by regenerating the used composition by electrolytic reduction, which makes the process of the present invention particularly ecological.

In addition to the compounds described above, the developing composition may contain development inhibitors such as potassium bromide, anti-fogging agents, a solvent for silver halides, a fixing solution, preservatives such as bisulphites, development accelerators such as quaternary ammonium compounds, antioxidants such as substituted dialkylhydroxylamines.

Although the activity of the inorganic developing compositions is relatively independent of the pH conditions, the inorganic developing compositions according to the invention have a pH below 7, and preferably between 3 and 6.

The photographic products that can be processed by means of the inorganic composition of the invention may comprise radiation-sensitive emulsions consisting of silver bromide, silver chloride, silver bromoiodide, silver chlorobromide, silver chloroiodide, silver chlorobromoiodide or others known in the art.

These emulsions can be sensitized according to the different methods described in Research Disclosure, September 1994, No 36544, published by Kenneth Mason Publications Ltd., Emsworth, Hampshire PO10 7DQ, England, Section IV. Other details of the elements and processing according to this invention are described in this reference.

The composition of the invention can be used for developing black and white films or photographic paper, products for the graphic arts or for the black and white development stage of reversal color films and photographic papers.

EXAMPLE 1 (CONTROL)

A film for medical X-ray is exposed using a sensitometer equipped with a lamp having a color temperature of 2850° K for 1/50 second. The sensitometer is equipped with a filter simulating green screen re-emission. The X-ray film thus exposed is developed using a processing that comprises a development stage at ambient temperature (3 min.), a fixing stage (2 min.) and a water washing stage (5 min.).

The development stage is conducted in a tank filled with the following composition, the surface of the developing composition being in contact with the air.

Developing composition:

$TiCl_3$ (0.2M) manufactured by Janssen®

EDTA (0.4M)

Anti-fogging agent (35 mg/l)

KBr (6 g/l)

The pH of the composition is 5.

The fixing bath is the RP X-OMAT® fixer.

The film is evaluated using a Macbeth® TD 903 densitometer.

A first sample of the exposed film is developed in the freshly prepared developing composition (T=0). Other samples of the film are then developed for times T=20, T=43 and T=66 hours with the same composition left exposed to air.

For each developed sample, the contrast (γ) and the discrimination (Δ)=(Dmax−Dmin) 100 are determined, Dmin being the minimum density and Dmax the maximum density.

The sensitometric results are set out in Table 1.

TABLE 1

| Time (h) | Δ | γ |
|---|---|---|
| T = 0 | 351 | 2.99 |
| T = 20 | 360 | 3.37 |
| T = 43 | 229 | 2.14 |
| T = 66 | 49 | 0.02 |

These results show the low resistance of this composition to oxidation in air. The activity of the developing composition remains acceptable up to 43 hours of contact with the air, though it begins to fall after only 20 hours in contact with air.

After 66 hours, this developing composition becomes unusable.

EXAMPLE 2 (INVENTION)

The same film for medical X-ray is exposed, developed and evaluated according to the method of Example 1, with a developing composition that contains:

$TiCl_3$ (0.2M)

EDTA (0.2M)

NTA (0.2M)

Anti-fogging agent (35 mg/l)

KBr (6 g/l)

The pH of the composition is 5.

The sensitometric results are set out in Table 2 and analyzed below.

TABLE 2

| Time (h) | Δ | γ |
|---|---|---|
| T = 0 | 360 | 3.32 |
| T = 22 | 397 | 3.66 |
| T = 46 | 395 | 5.53 |
| T = 118 | 391 | 5.49 |

EXAMPLE 3 (INVENTION)

The same film for medical X-ray is exposed, developed and evaluated according to the method of Example 1, using a developing composition that contains:

$TiCl_3$ (0.2M)

EDTA (0.25M)

NTA (0.15M)

Anti-fogging agent (35 mg/l)

KBr (6 g/l)

The pH of the composition is 5.

The sensitometric results are set out Table 3 and analyzed below.

TABLE 3

| Time (h) | Δ | γ |
|---|---|---|
| T = 0 | 344 | 3.05 |
| T = 20 | 380 | 3.33 |
| T = 43 | 388 | 4.92 |
| T = 67 | 389 | 3.53 |

EXAMPLE 4 (INVENTION)

The same film for medical X-ray is exposed, developed and evaluated according to the method of Example 1, using a developing composition that contains:

$TiCl_3$ (0.2M)

EDTA (0.1M)

NTA (0.3M)

Anti-fogging agent (35 mg/l)

KBr (6 g/l)

The pH of the composition is 5.

The sensitometric results are set out in Table 4 and analyzed below.

TABLE 4

| Time (h) | Δ | γ |
|---|---|---|
| T = 0 | 341 | 3.12 |
| T = 20 | 363 | 3.21 |
| T = 43 | 382 | 3.11 |
| T = 67 | 383 | 3.54 |

ANALYSIS OF EXAMPLES 2, 3 and 4

The sensitometric results of Examples 2, 3 and 4 show that the composition of the present invention has a resistance to oxidation in air that is higher than that of the control composition of Example 1. In all cases, that is to say from T=0 to T=67 hours, the sensitometric results obtained with the composition of the invention are superior to those obtained with the composition of Example 1.

As Example 2 shows, the activity can surprisingly be maintained with a composition left in contact with air for at least 118 hours.

Furthermore, the biodegradability of this composition is greater than that of example 1, because a significant part of the quantity of useful EDTA has been replaced by NTA (up to 75% in Example 3).

EXAMPLE 5 (COMPARATIVE)

The same film for medical X-ray is exposed, developed and evaluated according to the method of Example 1 with a developing composition that contains:

$TiCl_3$ (0.2M)

NTA (0.4M)

Anti-fogging agent (35 mg/l)

KBr (6 g/l)

The pH of the composition is 4.

The use of such a developing composition does not provide acceptable sensitometric results.

Other trials were conducted with modified Titanium/NTA molar ratio.

When the quantity of NTA in the developing composition is increased, acceptable sensitometric results are obtained, which are, however, inferior to those obtained with the compositions of the invention. Furthermore, a white precipitate appears in the composition and on the developed films, which limits the practical application of the composition.

EXAMPLE 6 (INVENTION)

The same film for medical X-ray is exposed, developed and evaluated according to the method of Example 2, except that, in the developing composition, NTA is replaced by ADA (0.2M) of formula:

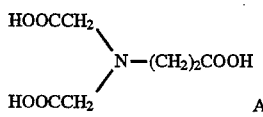

ADA

The sensitometric results are set out in Table 6 and analyzed below.

TABLE 6

| Time (h) | Δ | γ |
|---|---|---|
| T = 0 | 362 | 2.83 |
| T = 22 | 380 | 3.27 |
| T = 46 | 246 | 2.22 |

EXAMPLE 7 (INVENTION)

The same film for medical X-ray is exposed, developed and evaluated according to the method of Example 2, except that, in the development composition, NTA is replaced by GDPA (0.2M) of formula:

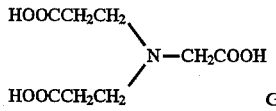

GDPA

The sensitometric results are set out in Table 7 and analyzed below.

TABLE 7

| Time (h) | Δ | γ |
|---|---|---|
| T = 0 | 355 | 2.83 |
| T = 22 | 370 | 3.26 |
| T = 46 | 238 | 2.21 |

EXAMPLE 8 (INVENTION)

The same film for medical X-ray is exposed, developed and evaluated according to the method of Example 2, except that, in the development composition, NTA is replaced by AIDA (0.2M) of formula:

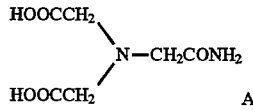

AIDA

The sensitometric results are set out in Table 8 and analyzed below.

TABLE 8

| Time (h) | Δ | γ |
|---|---|---|
| T = 0 | 334 | 2.93 |
| T = 22 | 357 | 3.54 |
| T = 46 | 218 | 1.85 |

EXAMPLE 9 (COMPARATIVE)

The same film for medical X-ray is exposed, developed and evaluated according to the method of Example 2, except that, in the developing composition, NTA is replaced by iminoacetic acid (IDA) (0.2M) of formula:

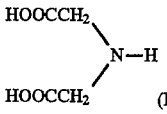

(IDA)

The sensitometric results are set out in Table 9 and analyzed below.

TABLE 9

| Time (h) | Δ | γ |
|---|---|---|
| T = 0 | 338 | 3.19 |
| T = 22 | 376 | 3.39 |
| T = 46 | 165 | 0.02 |

EXAMPLE 10 (COMPARATIVE)

The same film for medical X-ray is exposed, developed and evaluated according to the method of Example 2, except that, in the developing composition, NTA is replaced by methylene iminodiacetic acid (MIDA) (0.2M) of formula:

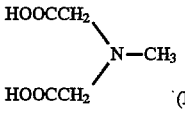

(MIDA)

The sensitometric results are set out in Table 10 and analyzed below.

TABLE 10

| Time (h) | Δ | γ |
|---|---|---|
| T = 0 | 347 | 3.28 |
| T = 22 | 371 | 3.57 |
| T = 46 | 154 | 0.02 |

ANALYSIS OF EXAMPLES 6 TO 10

The sensitometric results of Examples 6 to 10 show that the developing compositions of the present invention (Ex. 6, 7, 8) provides a stability in air that is either superior to that of the control developing composition (Ex. 1) which contains only EDTA as a complexing agent, or superior to that of developing compositions containing an additional complexing agent different from the complexing agent of Formula (I) (Ex. 9 and 10).

In Example 8, the sensitometric results obtained remain inferior to those obtained with the control composition of Example 1, but these results are much superior to those of the compositions of the comparative Examples 9 and 10, which are very sensitive to oxidation in air.

Although the sensitometric results obtained with the developing compositions of Examples 1, 9 and 10 when freshly prepared are comparable to the sensitometric results obtained with the compositions of the present invention, it is, however, clear that these results deteriorate very rapidly over the course of time (in particular the contrast).

Furthermore, the developing compositions of the invention have an improved biodegradability due to the partial substitution of the EDTA with a complexing agent (I) having a biodegradability superior to that of EDTA.

The invention has been described in detail with particular reference to preferred embodiments thereof, but it will be understood that variations and modifications can be effected within the spirit and scope of the invention.

We claim:

1. An inorganic photographic developing composition consisting essentially of at least 0.05M of at least one inorganic black-and-white developing agent that is an oxidizable metallic ion capable of reducing silver ions to silver metal, ethylenediamine tetraacetic acid, and at least one additional complexing agent of formula (I):

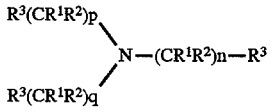

wherein $R^1$ and $R^2$ are each independently hydrogen, an alkyl group of 1 to 10 carbon atoms, hydroxyl, or hydroxyalkyl group, $R^3$ is —COOM wherein M is hydrogen or a counter-ion, or —$CONR^4R^5$ wherein $R^4$ and $R^5$ are each independently a hydrogen atom, or an alkyl group of 1 to 10 carbon atoms, and n, p and q are independently 1, 2 or 3, wherein the metallic ion/complexing agent molar ratio is between 1/1 and 1/10, and the molar concentration of said additional complexing agent (I) is equal to at least 10% of the total concentration of complexing agents.

2. The developing composition of claim 1, wherein the concentration of said oxidizable metallic ions is between 0.05M and the solubility limit of said metallic ions in said composition.

3. The developing composition of claim 2, wherein the concentration of said oxidizable metallic ions is between 0.1 and 0.5M, the total concentration of said complexing agents being such that the metallic ion/complexing agent molar ratio is between ½ and ¼, and the concentration of said additional complexing agent (I) is equal to between 50% and 90% of the total concentration complexing agent.

4. The developing composition of claim 1, wherein said additional complexing agent of formula (I) is such that at least one of the $R^3$ groups is a —COOM group wherein M is hydrogen or a counter-ion.

5. The developing composition of claim 4, wherein said additional complexing agent is β-alanine diacetic acid, nitrilotriacetic acid, (acetamido)iminodiacetic acid, N,N-dicarboxyethylglycine acid, or(dimethylacetamido) iminodiacetic acid.

6. The developing composition of claim 5, wherein said additional complexing agent is nitrilotriacetic acid.

7. The developing composition of claim 1 wherein said oxidizable metallic ion or ions are titanium, iron, vanadium or chromium ions.

8. The developing composition of claim 7 wherein said oxidizable metallic ion is titanium ion.

9. The composition of claim 1 having a pH of from 3 to 6.

10. The composition of claim 1 further including a development inhibitor, anti-fogging agent, silver halide solvent, fixing agent, preservative, development accelerator or antioxidant.

11. The composition of claim 1 wherein said additional complexing agent of formula (I) comprises at least 50% of the total concentration of said complexing agents.

* * * * *